United States Patent [19]

Bischof et al.

[11] Patent Number: 4,925,326

[45] Date of Patent: May 15, 1990

[54] TRANSPORT DEVICE FOR EDGE-PERFORATED RECORDING SUPPORT MATERIAL

[75] Inventors: Stefan Bischof, Ulm-Jungingen; Gerhard Lohrmann, Elchingen-Thalfingen; Michael Setz, Beimerstetten, all of Fed. Rep. of Germany

[73] Assignee: Mannesmann Aktiengesellschaft, Düsseldorf, Fed. Rep. of Germany

[21] Appl. No.: 159,776

[22] Filed: Feb. 24, 1988

[30] Foreign Application Priority Data

Feb. 24, 1987 [DE] Fed. Rep. of Germany ..... 3705858

[51] Int. Cl.[5] ..... B41J 11/26

[52] U.S. Cl. ..... 400/616.1; 226/74

[58] Field of Search ..... 400/616, 616.1, 616.2, 400/616.3; 226/74, 75, 76, 77, 78, 79, 80, 81, 82, 83, 84, 85, 86

[56] References Cited

U.S. PATENT DOCUMENTS 2,140,028 12/1938 Nichols ..... 400/616.1

4,130,230 12/1978 Seitz ..... 226/75

4,199,091 4/1980 Hubbard ..... 226/74

4,469,262 9/1984 Seitz ..... 226/74

FOREIGN PATENT DOCUMENTS 3230008 4/1983 Fed. Rep. of Germany .

*Primary Examiner*—Ernest T. Wright, Jr.

*Attorney, Agent, or Firm*—Horst M. Kasper

[57] ABSTRACT

A transport device for edge-perforated recording support material (1) comprises two casing parts (2, 6) disposed at a distance relative to the perforation edges (1*a*) for drivable endless pin belts (5) with respectively a guide flap (4) for the recording support material (1), where the casing in each case comprises two casing parts (2, 6) disposed next to one another, and where the guide flap (4) is tiltably disposed on a first casing part (2), where inner and outer guide ribs (7, 10, 11) for the pin belt (5) are provided, where aligned disposed means for the detachable attachment of the two casing parts (2, 6) are provided aligned at the first and the second casing parts (2, 6) where at least the inner guide ribs (7) form a rest contact surface (6*a*) for the second casing part (6).

18 Claims, 1 Drawing Sheet

TRANSPORT DEVICE FOR EDGE-PERFORATED RECORDING SUPPORT MATERIAL

BACKGROUND OF THE INVENTION

1. Field of the Invention

The invention relates to a transport device for edge-perforated recording support materials comprising two casings, disposed at the perforated edges, for drivable endless pin belts with, respectively, a guide flap for the recording support materials.

2. Brief Description of the Background of the Invention Including Prior Art

Such transport devices designated as push or pull tractors are employed in printers of all types, in particular in matrix printers, for a very accurate paper advance performable in very precise steps. The transport devices are disposed in mirror-image position on a driven shaft and on a guide rod running parallel to the driven shaft and they can be set to the respective width of the paper provided with the perforated edges. In order to achieve an accurate paper advance, the same advance force is always required, which is transferred via the pins of the pin belts. Such transport devices include only few parts and, in general, do not need any maintenance.

Such a paper tractor is known from U.S. Pat. No. 4,199,091. The paper tractor is provided with a pin belt, having a frame of injection-molded material, where a plate pair is provided where, in a side-by-side disposition, one plate exhibits a hub, which hub protrudes at the side, whereby the second plate is disposed oppositely and is provided with inner and outer guide ribs for the pin belt. In addition, a mechanism for the detachable attachment of the two plates is known, where openings are provided through the inner guide rib, which engage in blocking latches, which blocking latches in turn are provided on the opposite plate. In order to generate such blocking latches by injection molding of plastic material, it is required to guide through the respective plate a larger mold bore in order to be able to form the injection molding tool correspondingly. However, as has been shown in practice, such blocking latches are associated with substantial disadvantages. In case of a disengagement of the two plates, the blocking latches have to be bent very far in order to release the locking engagement. In this process, the plastic is frequently excessively stressed and overloaded by inexperienced personnel and operators such that the blocking latches break off.

SUMMARY OF THE INVENTION

1. Purposes of the Invention

It is an object of the present invention to provide a mechanism for the disengageable attachment of two casing parts to each other, which excludes damage during mounting and demounting of the casing parts.

It is a further object of the present invention to provide an attachment mechanism for two casing parts which is constructed such that a repeated detachment of the mechanism does not result in any damages to the mechanism itself.

It is yet another object of the present invention to provide an attachment mechanism which does not require any parts produced separately from the casing parts.

These and other objects and advantages of the present invention will become evident from the description which follows.

2. Brief Description of the Invention

A transport device for edge-perforated recording-support materials comprises a first casing part disposed in a first direction at a distance relative to the perforation edges for drivable, endless pin belts. The first casing part includes a base plate and hinge means for supporting a guide flap and comprises a joinable casing part construction. A second casing part is disposed at a distance in a second direction relative to the perforation edges for drivable, endless pin belts. The second casing part comprises joinable casing parts for a matching attachment to the first casing part and a bore aligned relative to the first casing part. A guide flap is tiltably disposed on the first casing part for positioning recording-support material. Inner and outer guide ribs, attached to the first casing part, are provided for maintaining the perforated edge engaged by the pin belt. At least the inner guide ribs form a contact surface for the second casing part. A hollow perpendicular standing body, with a defined traversing bore hole penetrating the base plate of the first casing part, is formed on the first casing part inside of the inner guide rib. An expanding mandrel for a detachable attachment of the second casing part is guided through the aligned bore of the second casing part and is pressed in the traversing bore hole of the hollow perpendicular standing body thereby providing a flush, detachable attachment of the first casing part and of the second casing part.

The first casing part with the inner guide ribs and the outer guide ribs, disposed in the return regions of the drivable endless pin belt, as well as the hollow perpendicular standing bodies, can be formed of a one-piece body.

The hollow perpendicular standing body of the first casing part can be provided with a slot running crosswise to the longitudinal axis of the bore at the entrance of the traversing bore.

The expanding mandrels can be of injected material by concurrent plastic injection molding at the second casing part and can be held within the aligned bore hole for the expanding mandrel. Crosswebs can hold the expanding mandrel in mounting position with the crosswebs breaking under impact stress or shock load. The crosswebs can have a diameter of from about 0.1 to 0.4 the diameter of the expanding mandrel.

The hollow perpendicular standing bodies of the first casing part can be provided with a slot running crosswise to the longitudinal axis of the bore at the entrance of the traversing bore. The slot can be aligned with a respective crossweb. Preferably, the mandrel and the crossweb do not protrude on the second casing part by more than the thickness of the actual second casing part.

The hollow perpendicular standing body of the first casing part can be provided with a bore hole having a diameter from about 0.2 to 0.4 of the outer diameter of the perpendicular standing body.

The inner guide rib can be formed as a cylinder section in the area of the belt return.

Preferably, the perpendicular standing body is disposed within a middle third between nearly straight belt sections moving parallel in forward direction and in return direction.

According to the invention, the transport device is constructed such that one or several hollow perpendicular standing bodies, with respectively defined bores traversing the base plate of the first casing part, are matchingly attached at the first casing part within the inner guide rib, and that the means for the detachable attachment of the second casing part include respectively an expanding mandrel, which is guided through an aligned bore of the second casing part and which is pressed into the traversing bore of the hollow perpendicular standing body. Damages of the individual parts of the transport device are thereby excluded and, in addition, even small damages of the attachment means for the detachable attachment of the two casing parts cannot occur. However, a repeated demounting and remounting of the two casing parts is possible without difficulties.

It is provided as a further feature of the invention that the first casing part, with the inner guide ribs and with the outer guide ribs of the endless pin belt drivable in the return region, as well as the hollow perpendicular standing bodies, are formed of a one-piece body. Thus, the main part of the transport device can be produced economically as an injection-molded part.

It is further provided as a feature of the invention that the hollow perpendicular standing bodies of the first casing part are provided at the entrance of the traversing bore with at least one slot running crosswise to the longitudinal axis of the bore. Thereby, the expanding effect of the expanding mandrel or, respectively, of the perpendicular standing body is increased.

The economic production of the transport device is further enhanced, where additional advantages are generated during the first mounting by concurrently injecting molding the expanding mandrels at the second casing part within the aligned bores, respectively, for one expanding mandrel by injection molding of plastic. These expanding mandrels are held in mounting position with crosswebs which break upon impact stress.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
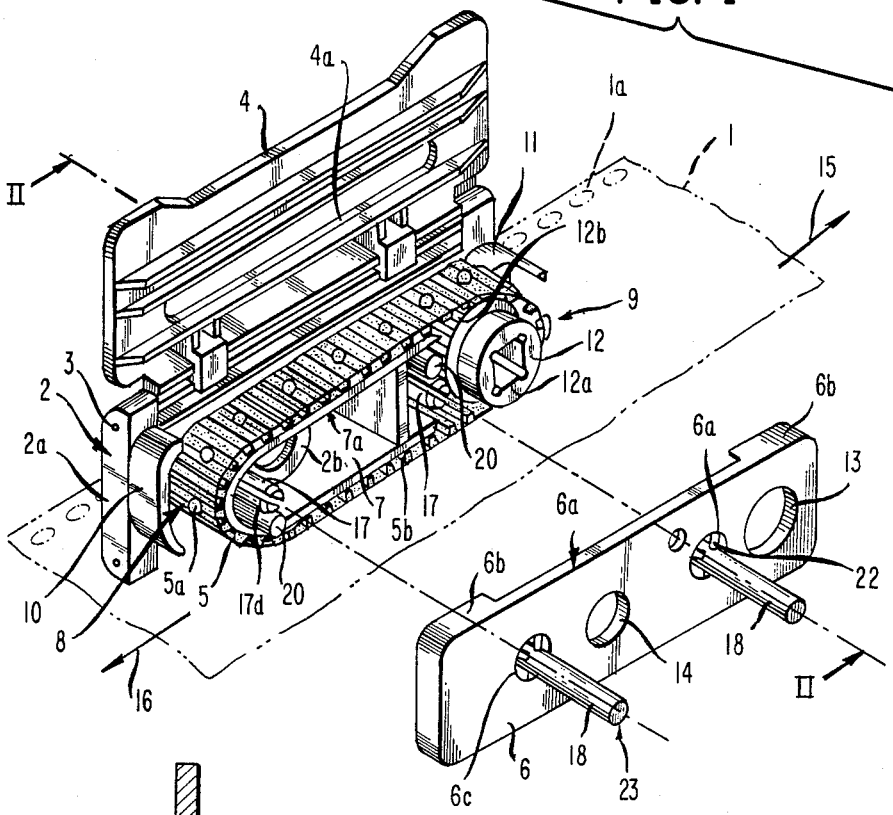
FIG. 1 is a perspective view of the exploded casing parts, where the guide flap for the recording support material is illustrated in open position.
Figure 2:
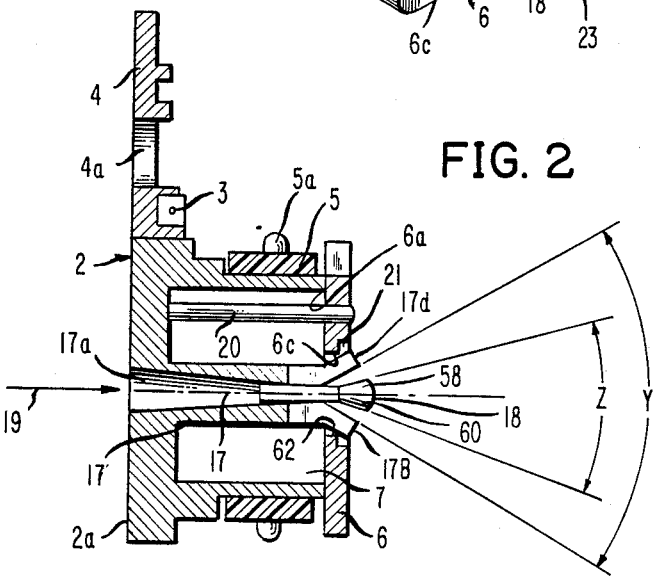
FIG. 2 is a vertical cross-sectional view through the transport device according to FIG. 1 along the section line II—II.

In accordance with the present invention, there is provided a transport device for edge-perforated recording-support materials comprising two casings disposed at a distance relative to the perforated edges for drivable, endless pin belts with, in each case, a guide flap for positioning the recording-support material. The casings comprise respectively two joinable casing parts. The guide flap is tiltable disposed on a first casing part. Inner and outer guide ribs are provided for the pin belt. Means disposed flush at the first and the second casing part are provided for a detachable attachment of the two casing parts. At least the inner guide rib forms a contact surface for the second casing part. One or several hollow perpendicular standing bodies 17 with, respectively, defined bore holes 17*a* penetrating a base plate 2*a* of the first casing part 2 are formed on the first casing part 2 inside of the inner guide rib 7. The means for the detachable attachment of the second casing part 6, respectively, comprise an expanding mandrel 18 which is guided through an aligned bore 6*c* of the second casing part 6 and which is pressed in the traversing bore hole 17*a* of the hollow perpendicular standing body 17.

The first casing part 2 with the inner guide rib 7 and outer guide ribs 10, 11 disposed in the return regions 8, 9 of the drivable endless pin belt 5, as well as the hollow perpendicular standing bodies 17, can be formed of a one-piece body.

The hollow perpendicular standing bodies 17 of the first casing part 2 can be provided with a slot 17*d* running crosswise to the longitudinal axis 17*c* of the bore hole 17*a* at the entrance 17*b* of the traversing bore hole 17*a*.

Preferably, the expanding mandrels 18 are injected concurrently by plastic injection molding at the second casing part 6 into the respective aligned bores 6*c* constructed for one expanding mandrel 18. The expanding mandrel 18 can be held in mounting position 23 with crosswebs 22 breaking under impact stress or shock load.

The transport device is illustrated for one side of an edge-perforated recording support material 1 in FIG. 1. The first casing part 2 supports a rotary axle 3 for a guide flap 4, which is flapped or folded downwardly during operation onto the recording support material 1 and which presses thereby the recording support material 1 onto the endless pin belts 5 with pins 5*a* drivable and coordinated to each perforated edge 1*a*. The pins 5*a* protrude in operating position of the guide flap 4 into a recess 4*a* of the guide flap 4.

Each of the casings, which are coordinated to a perforated edge 1*a*, include a first casing part 2 and a second casing part 6.

The first casing part 2 carries in addition to the guide flap 4 also an inner guide rib 7 and, in each case, outer guide ribs 10 or, respectively, 11 in the return regions 8 and 9 for the pin belt 5. In addition, a gear wheel 12 is disposed in the return region 9. The gear wheel 12 includes a polygonally formed traversing recess 12*a* for a matchingly formed polygonal rotary drive rod, which is not illustrated. An aligned opening 13 for the passage of this rotary drive rod is disposed in the second casing part 6. An eye 2*b* is injection-molded to a base plate 2*a* of the first casing part 2 for providing a guide rod, which is again not illustrated for purposes of simplicity. An opening 14 is provided in the second casing half 6 for the same purpose. The rotary drive rod, the guide rod, and therefore the recess 12*a*, the eye 2*b*, and the openings 13 and 14 run with their axes disposed in parallel.

The second casing part 6 can be placed with its inner side face 6*a* against a rest surface 7*a* of the inner guide rib 7, where the pin belt 5 is carried along in the return region 8 and 9 through the casing part thickness 6*b*.

Alignment means 17, 18 are disposed for the first casing part 2 and the second casing part 6, which alignment means 17, 18 can connect the two casing parts 2, 6 to each other in a detachable way. The detachability and releasability of the alignment means 17, 18 serve for the accessibility to the pin belt 5 and to the gear wheel 12, which gear wheel 12 engages its teeth 12*b* into a counter toothing 5*b* of the pin belt 5. Such an access is important in view of the same position of the pins 5*a* in two casings, with reference to the respective perforated edges 1*a*, and also considered crosswise to the paper course directions 15 or, respectively, 16. These alignment means 17, 18 for the detachable attachment of the two casing parts 2 and 6 are now formed such that the first casing part 2 is provided with several hollow perpendicular standing bodies 17 within the inner guide rib 7 with defined bore holes 17*a*, which can be formed running slightly conically and outwardly in the direction of the base plate 2*a*, as made possible by a production method such as injection molding of plastic. The perpendicular standing bodies 17 protrude with their right ends up to the bores 6*c* of the second casing part 6. Expanding mandrels 18 are guided and pressed into the bore holes 17*a* through the bores 6*c*. The expanding mandrels 18 or expanding arbors can be pushed out easily again with a pin tool in the direction 19 without the danger and fear of damage to any part of the transport device. The first casing part 2 with the inner guide rib 7, with the outer guide ribs 10 or, respectively 11, as well as the hollow perpendicular standing bodies 17 and, if desired, additional guide pins 20, form together one signle body made out of thin material walls, which single body can be formed by injection molding of plastic.

The pressing force of the expanding mandrel 18 can be increased by providing at the entrance 17*b* one or several slots 17*d* running crosswise to the longitudinal axis 17*c* of the bore hole 17*a*, where the expanding mandrel 18 expands in particular the slotted part of the perpendicular standing bodies 17. In addition, a step bore 21 is provided in the second casing part 6 for obtaining a larger expansion.

The expanding mandrels 18 can be concurrently molded during the production of the second casing part 6 by injection molding them with crosswebs 22 in the mounting position 23 illustrated in FIG. 1. The expanding mandrel 18 can be provided at its end remote from the first casing part 6 with an expanded head 58 forming a conical expansion of the mandrel 18. The conical expansion angle Z can be from 20° to 50°. The length of the expanding section 60 can be from about 0.2 to 0.4 of the total length of the expanding mandrel 18. The perpendicular standing body 17 can be provided in the area remote from the first casing part 2 with an outer conical section 62 which eases insertion of the perpendicular standing body 17 into the second casing part 6. The cone angle Y can be from 60° to 120°. The diameter of the crossweb 22 can be from 0.1 to 0.4 and is preferably from about 0.2 to 0.3 the diameter of the perpendicular standing body 17.

It will be understood that each of the elements described above, or two or more together, may also find a useful application in other types of paper transport devices differing from the types described above.

While the invention has been illustrated and described as embodied in the context of a transport device for edge-perforated recording support material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A transport device for edge-perforated recording-support materials comprising a first casing part disposed in a first direction at a distance relative to perforation edges for drivable, endless pin belts, where the first casing part includes a base plate and hinge means for supporting a guide flap;

a second casing part disposed at a distance in a second direction relative to the perforation edges for drivable, endless pin belts;

a guide flap tiltably disposed on the first casing part for positioning recording-support material; inner and outer guide ribs attached to the first casing part provided for maintaining the perforation edge engaged by the pin belt where at least the inner guide rib forms a contact surface for the second casing part;

a hollow perpendicular standing body with a defined traversing bore hole penetrating the base plate of the first casing part formed on the first casing part inside of the inner guide rib; and an expanding mandrel for a detachable attachment of the second casing part, which mandrel is guided through an aligned bore of the second casing part and which mandrel is pressed in the traversing bore hole of the hollow perpendicular standing body thereby providing a flush, detachable attachment of the first casing part and of the second casing part.

2. Transport device according to claim 1, wherein the first casing part with the inner guide rib and the outer guide ribs, disposed in return regions of the drivable endless pin belt, as well as said hollow perpendicular standing body, are formed of a one-piece body.

3. Transport device according to claim 1, wherein the hollow perpendicular standing body of the first casing part is provided with a slot running crosswise to a longitudinal axis of the traversing bore hole at the entrance of the traversing bore hole.

4. Transport device according to claim 1, wherein said expanding mandrel is of injected material formed by concurrent plastic injection molding on the second casing part and is held within an aligned bore hole for each expanding mandrel; and further comprising crosswebs holding the expanding mandrel in mounting position with the crosswebs breaking under impact stress or shock load.

5. Transport device according to claim 4, wherein the crosswebs have a diameter of from about 0.1 to 0.4 times the diameter of each expanding mandrel.

6. Transport device according to claim 4, wherein the hollow perpendicular standing body of the first casing part is provided with a slot running crosswise to a longitudinal axis of the traversing bore hole at the entrance of the traversing bore hole and wherein the slot is aligned with a respective crossweb.

7. Transport device according to claim 4, wherein each mandrel and the crosswebs do not protrude on the second casing part by more than the thickness of an actual second casing part.

8. Transport device according to claim 1, wherein the hollow perpendicular standing body of the first casing part is provided with the traversing bore hole having a diameter from about 0.2 to 0.4 of the outer diameter of the perpendicular standing body.

9. Transport device according to claim 1, wherein the inner guide rib is formed as a cylinder section in the area of a belt return.

10. Transport device according to claim 1, wherein the perpendicular standing body is disposed between nearly straight belt sections moving parallel in forward direction and in return direction.

11. Transport device for edge-perforated recording-support materials comprising two casings disposed at a distance relative to perforation edges for drivable, endless pin belts with, in each casing, a guide flap on each casing for positioning the recording-support material, where the casings comprise respectively two joinable casing parts, and where the guide flap is tiltably disposed at a first casing part, inner and outer guide ribs are provided for each pin belt, means disposed flush at the first and the second casing part are provided for a detachable attachment of the two casing parts, where at least the inner guide rib forms a contact surface for the second casing part, wherein one hollow perpendicular standing body (17) with, a defined bore hole (17*a*) penetrating a base plate (2*a*) of the first casing part (2) is formed on the first casing part (2) inside of the inner guide rib (7) and where the means for the detachable attachment of the second casing part (6) comprises an expanding mandrel (18) which is guided through an aligned bore (6*c*) of the second casing part (6) and which is pressed in the defined bore hole (17*a*) of the hollow perpendicular standing body (17).

12. Transport device according to claim 11, wherein the first casing part (2) with the inner guide rib (7) and outer guide ribs (10, 11) disposed in return regions (8, 9) of a drivable endless pin belt (5), as well as the hollow perpendicular standing body (17), are formed of a one-piece body.

13. Transport device according to claim 11, wherein the hollow perpendicular standing body (17) of the first casing part (2) is provided with a slot (17*d*) running crosswise to a longitudinal axis (17*c*) of the bore hole at an entrance (17*b*) of the defined bore hole (17*a*).

14. Transport device according to claim 11, wherein the expanding mandrel (18) is injected concurrently by plastic injection molding on the second casing part (6) within the aligned bore (6*c*) for, respectively, one expanding mandrel (18) and where the expanding mandrel is held in mounting position (23) with crosswebs (22) breaking under impact stress or shock load.

15. Transport device for edge-perforated recording-support materials comprising two casings disposed at a distance relative to perforation edges for drivable, endless pin belts with, in each casing, a guide flap on each casing for positioning the recording-support material, where the casings comprise respectively two joinable casing parts, and where the respective guide flap is tiltably disposed on a first casing part, inner and outer guide ribs are provided for the respective pin belt, means disposed flush at the first and the second casing part are provided for a detachable attachment of the two casing parts, where at least the inner guide rib forms a contact surface for the second casing part, wherein several hollow perpendicular standing bodies (17) with, respectively, defined bore holes (17*a*) penetrating a base plate (2*a*) of the first casing part (2) are formed on the first casing part (2) inside of the inner guide rib (7) and where the means for the detachable attachment of the second casing part (6), respectively, comprise an expanding mandrel (18) which is guided through an aligned bore (6*c*) of the second casing part (6) and which is pressed in the traversing bore hole (17*a*) of the respective hollow perpendicular standing body (17).

16. Transport device according to claim 15, wherein the first casing part (2) with the inner guide rib (7) and outer guide ribs (10, 11) disposed in return regions (8, 9) of the drivable endless pin belt (5), as well as hollow the perpendicular standing bodies (17), are formed of a respective one-piece body.

17. Transport device according to claim 15, wherein the hollow perpendicular standing bodies (17) of the first casing part (2) are provided with a slot (17*d*) running crosswise to a longitudinal axis (17*c*) of the bore holes at an entrance (17*b*) of the traversing bore holes (17*a*).

18. Transport device according to claim 15, wherein the expanding mandrels (18) are injected concurrently by plastic injection molding on the second casing part (6) within the aligned bore (6*c*) for, respectively, one expanding mandrel (18) and where the expanding mandrel is held in mounting position (23) with crosswebs (22) breaking under impact stress or shock load.

* * * * *